US005743389A

United States Patent [19]

Cutler et al.

[11] Patent Number: 5,743,389

[45] Date of Patent: Apr. 28, 1998

[54] REVERSIBLE FOOD AND BEVERAGE VESSEL CARRIER

[75] Inventors: Donna Cutler; Thomas Cutler, both of Kirkland; Per-Axel Lindstrom, Bellevue; William Kawahara, Mercer Island, all of Wash.

[73] Assignee: CLK Factor, Inc., Kirkland, Wash.

[21] Appl. No.: 757,825

[22] Filed: Nov. 27, 1996

Related U.S. Application Data

[63] Continuation-in-part of Ser. No. 501,148, Jul. 11, 1995, abandoned.

[51] Int. Cl.[6] ..... B65D 77/00

[52] U.S. Cl. ..... 206/216; 206/194; 206/199; 229/117.14; 229/904; 229/932

[58] Field of Search ..... 206/152, 153, 206/154, 158, 168, 162, 139, 140, 199, 200, 216, 194, 427, 549; 229/117.14, 904, 932; 53/134.1, 413; 493/88, 909; 294/87.2

[56] References Cited

U.S. PATENT DOCUMENTS

| | | | |
|---|---|---|---|
| 1,140,540 | 5/1915 | Smith | 229/932 |
| 1,367,174 | 2/1921 | Botnen | 229/932 |
| 1,448,866 | 3/1923 | Redoute | 229/932 |
| 1,981,647 | 11/1934 | Johnson | 206/427 |
| 1,983,010 | 12/1934 | Spees | 206/427 |
| 2,023,852 | 12/1935 | Oser et al. | 229/932 |
| 2,238,545 | 4/1941 | Whiley | 206/427 |
| 2,513,762 | 7/1950 | Tyson, Jr. | 229/932 |
| 4,184,595 | 1/1980 | Wackerman | 229/117.14 |
| 4,399,939 | 8/1983 | Tunick | 229/117.14 |
| 5,205,474 | 4/1993 | Stuart et al. | 229/904 |

FOREIGN PATENT DOCUMENTS

| | | | |
|---|---|---|---|
| 114538 | 7/1969 | Denmark | 229/932 |

*Primary Examiner*—David T. Fidei
*Attorney, Agent, or Firm*—David L. Tingey

[57] ABSTRACT

Prepared flat paper stock blank is disposed for assembly into a dual-configuration food and beverage carrier, selectively folded into an upright box with upward-extending side walls and end walls with handle panels extending from the box base around the side walls and meeting over the box as a handle or alternatively into an inverted box with downwardly-extending side and end walls with handle panels extending from the base upward and away from the side walls. When the handle panels are folded toward and around the base side walls, the carrier is disposed to enclose foodstuffs placed in the carrier. When the handle panels are folded away from the base side walls, the carrier becomes a cup and cone carrier, the box being carried inverted. One or more holes are provided in the base section for receiving cups and cones. Hinged sectors are provided at the hole perimeter to cover the hole, lightly connected until mildly urged downward to receive a cup thereby breaking the light connection.

7 Claims, 2 Drawing Sheets

REVERSIBLE FOOD AND BEVERAGE VESSEL CARRIER

This is a continuation-in-part of Ser. No. 08/501,148, filed in the United States Jul. 11, 1995, now abandoned.

BACKGROUND OF THE INVENTION

The present invention relates to beverage vessel, or cup, carriers and more particularly to foldable paperboard carriers.

It is known in the art to have paperboard cup carriers. Such cup carriers are common for carrying drinks from a food provider, such as in a fast food restaurant or a sports stadium. It is usual that such carriers provide a plurality of holes in a base for inserting a cup. Above and attached to the base is commonly a handle panel means comprising a panel extending up the middle of the base with holes for cups on each side of the panel with a hole near the top of the panel through which a user's hand can pass in carrying the carrier.

With cups that hold beverages carried outside the handle panel means, fluid from the cups may easily spill from the cups. And foodstuffs fall from carriers without enclosing side walls. None of the previous paperboard folding cup carriers have splash protection and enclosing side walls.

It is also unknown to have a collapsible, dual-configuration carrier which serves as a food and beverage carrier in one configuration and as a sturdy beverage cup carrier when folded into a second configuration.

Therefore, it is an object of the present invention to have provide a foodstuffs carrier supported at its base for strength. It is a further object that the carrier include handle panels from which the carrier hangs. It is another object to provide a versatile dual configuration carrier. It is still another object that in a first configuration, the carrier be adapted to retain foodstuffs placed therein with enclosing side and end walls. It is also an object that in a second configuration, the carrier provides a platform base strengthened to prevent collapse or folding under load of cups and also supported by handles from which the carrier hangs during use.

SUMMARY OF THE INVENTION

These objects are achieved in the food and beverage carrier of this invention which presents a dual-configuration, collapsible food carrier, adapted as a side-walled carrier when folded into a first configuration and as a beverage cup or ice cream cone carrier when folded into a second configuration. The carrier is typically formed from flat paper stock blank cut and marked with fold lines for ease in assembly of a carrier with splash protection with a stable base section supported by two handle panels hinged respectively from opposite sides of the base joining at their distal ends to form a triangular structure over the base. In the first configuration, the box is upright, and the handle panels fold upward around the upright box, the box forming a tray with walls around its perimeter to retain foodstuffs placed therein. Independently from foodstuff retaining walls, the carrier is supported by the handles at its base where the carrier load is focussed while separately providing enclosing side and end walls.

In the second configuration, the handle panels hinge from the base sides and are disposed to fold over cups (or cones) placed in holes in the base with the carrier essentially comprising an inverted box hanging from its base from the handle panels and strengthened by circumferential side and end walls depending downward from the base to assure structural integrity of the carrier under heavy load conditions. That is, in the second configuration, the side and end walls prevent the base from collapsing or folding when loaded by stengthening the base ends.

DESCRIPTION OF THE PREFERRED EMBODIMENTS

Figure 1:
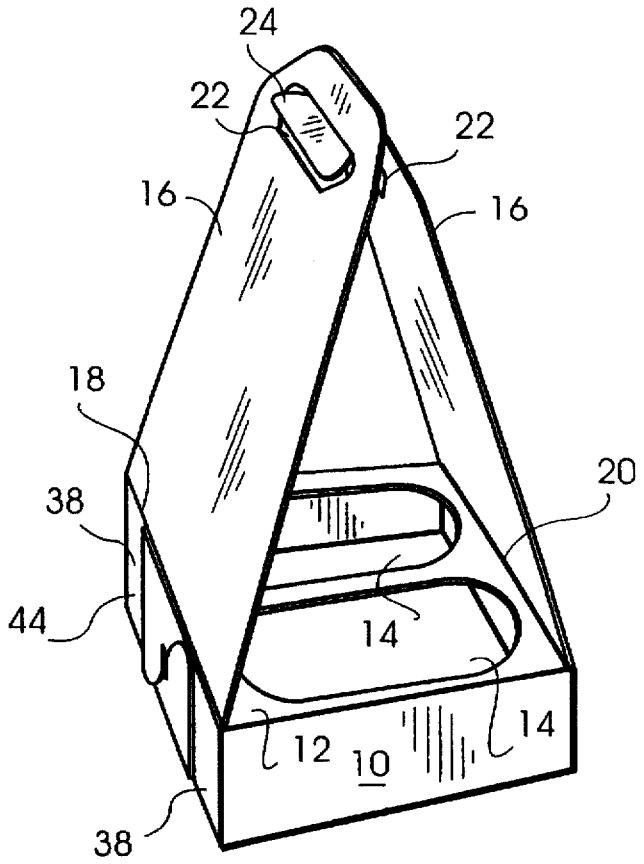
FIG. 1 is a front perspective view of an assembled beverage vessel carrier in a first and primary configuration.
Figure 2:
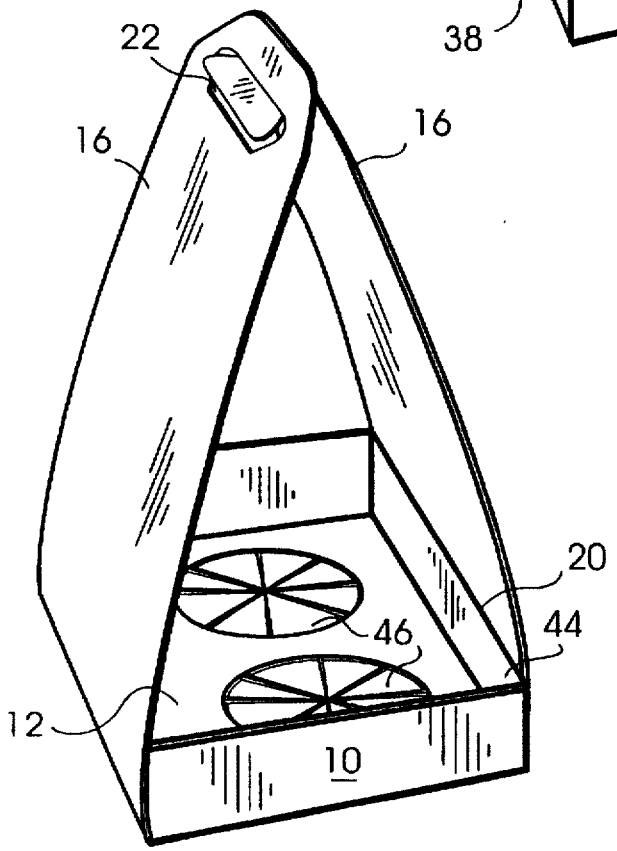
FIG. 2 is a front perspective view of an assembled beverage vessel carrier in a second, or alternate, configuration.
Figure 3:
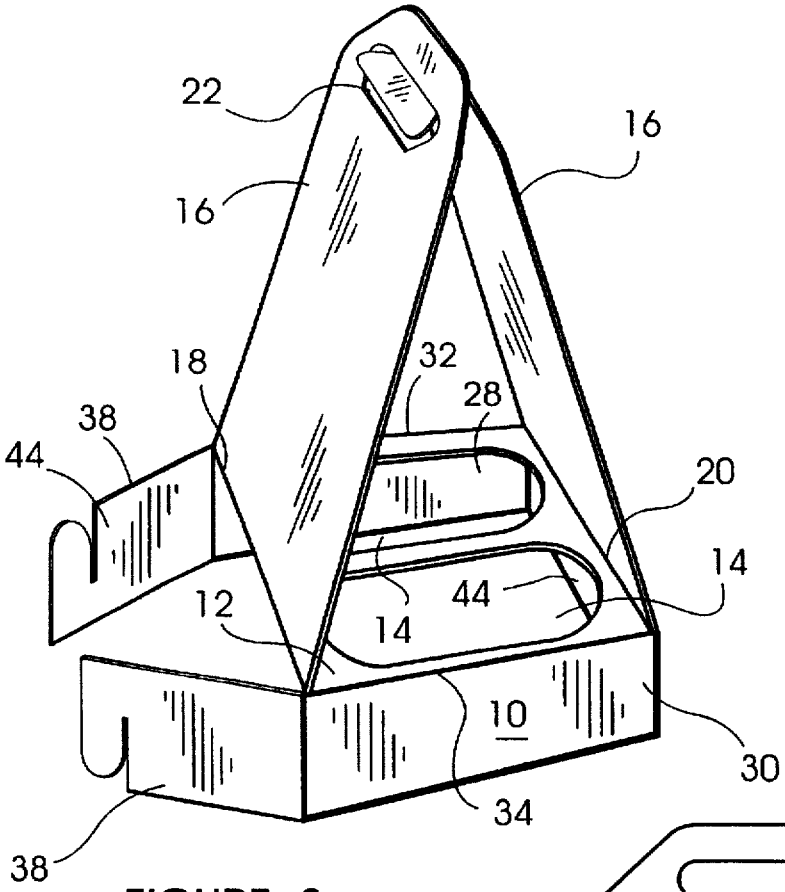
FIG. 3 is a front perspective view of the beverage vessel with the stabilizing arms and the handle panels yet to be interlocked.
Figure 4:
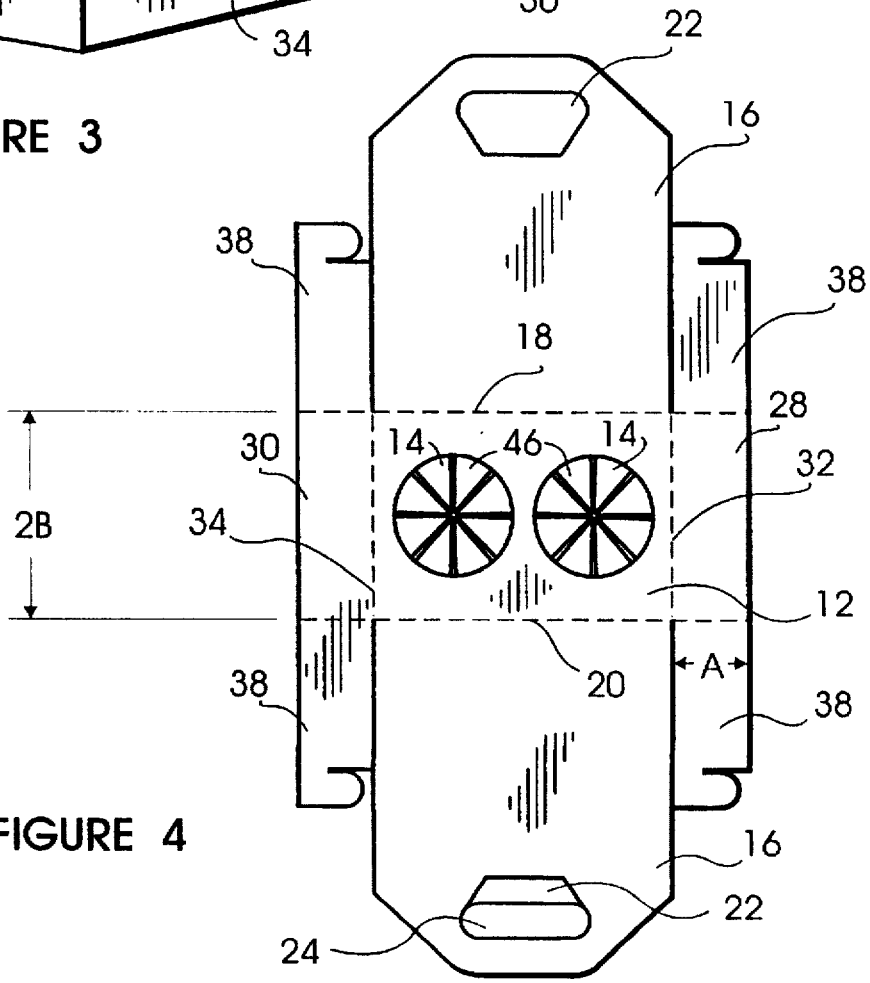
FIG. 4 is a shape of a blank with fold lines marked.

Referring to the figures, the beverage vessel carrier 10 of the present invention comprises a blank adapted to be folded into a box including a base 12 with at least one hole 14 having opposite base sides 18 and 20 and having opposite base ends 32 and 34 of width, 2B, and having end walls 28 and 30 depending from base ends 32 and 34. A pair of side wall arms 38 attach to each of the end walls 28 and 30, the width of the arms 38 on the end walls 28,30 being within a distance, A, from the base ends 32,34. Each side wall arm 38 is disposed toward a side wall arm attached to an opposite end wall when the blank is folded, therein forming side walls 44. Thus, the end walls and side walls form an open box with the base as its bottom.

Side arms 38 may be interlocked by means of matching slits in the side arms 38 with an arm from one end wall overlapping an opposing arm from an opposite end wall, a slit from one arm meshing with a matching slit in the other arm to form a side wall on each base side, the side and end walls forming a box with the base as its bottom.

A pair of handle panels 16 extend from opposite base sides 18, 20, one panel from each of the base sides, a distance from the base sides 18,20 substantially greater than the sum of distances A and B such that the panels 16 are foldable alongside and around respective adjacent side walls 44 when the carrier is assembled, joining together at their distal ends to form a handle over the open box. The box is thereby covered by the handle panels 16 and supported by said handle panels from the box base 12 to form a triangular cavity over the base. Alternatively, the panels 16 are foldable away from respective side walls, similarly joining together over their distal ends to form a handle over the box base, the open box directed away from the handles.

Outward in each panel are panel apertures 22 which meet to form a handle slot through which a user's hand or fingers can pass for lifting the base from the handle panels. In one panel may be a handle interlocking portion 24 rotating into and upward into the aperture of the other handle panel aperture thereby engaging and interlocking the handle panels.

The base circular holes further comprise sectors 46 hinged at the circle arc or a chord approximating the arc, and radially cut to extend separately to effectively cover the hole. Until depressed, the sectors 46 support foodstuffs generally, but when depressed, as by a cup inserted into the hole, the sectors hinge downward exposing the hole to the cup.

The embodiments described are preferred but is not meant to limit the scope of the present invention. All equivalent embodiments are intended to be included herein.

Having described the invention, what is claimed is:

1. A food and beverage vessel carrier comprising a blank adapted to be folded into a box including a base having opposite base sides and having opposite first and second ends of width, 2B, and having end walls depending from base ends and further having a pair of side walls arms attached to each of the end walls the width of the arms on the end walls being within a distance, A, from the base ends with each side wall arm disposed to interlock with a side wall arm attached to an opposite end wall when the blank is folded therein forming side walls, the end walls and side walls forming an open box with the base as its bottom, the improvement comprising a pair of handle panels, one panel extending on the unfolded blank from each of the base sides a distance from the base sides substantially greater than the sum of distances A and B such that the panels are foldable alongside and around respective adjacent side walls when the carrier is assembled into an upright box having four sides and a bottom and open at a top, joining together at their distal ends to form a handle over the open, upright box, the box thereby covered by the handle panels and supported by said handle panels from the box bottom.

2. The carrier of claim 1 in which each panel has an aperture near its distal end such that the panels are disposed to join together near the panel apertures, the apertures together forming a handle slot sized such that a user's fingers may pass into the slot for carrying the carrier.

3. The carrier of claim 2 in which each panel aperture is spaced apart from the base side from which the panel extends a distance greater than the sum of distances A and B.

4. The carrier of claim 1 further comprising a base section having at least one base hole for receive a cup.

5. The carrier of claim 4 further comprising sectors hinged at the base holes each extending radially into the holes to effectively cover them such that until depressed, the sectors support foodstuffs generally, but when depressed, as by a cup inserted into a hole, the hole sectors hinge downward exposing the hole to the cup.

6. A dual-configuration food and beverage vessel carrier comprising a blank adapted to be folded into a box including a base having opposite base sides and having opposite first and second ends of width, 2B, and having end walls depending from base ends and further having a pair of side walls arms attached to each of the end walls the width of the arms on the end walls being within a distance, A, from the base ends with each side wall arm disposed to interlock with a side wall arm attached to an opposite end wall when the blank is folded therein forming side walls, the end walls and side walls forming an open box with the base as its bottom, the improvement comprising a pair of handle panels, one panel hinged and extending on the unfolded blank from each of the base sides a distance from the base sides substantially greater than the sum of distances A and B such that the panels are selectively foldable when the carrier is assembled either a) alongside respective adjacent side walls, joining together at their distal ends to form a handle over the open box, or b) away from the side walls joining together at their distal ends to form a handle over the box base, the open box directed away from the handles, in both cases the box being supported by said handle panels from the box bottom.

7. A food and beverage vessel carrier formed from a foldable blank and comprising an upright box including a base having opposite base sides and having opposite first and second ends of width, 2B, and having end walls extending upward from base ends and further having a pair of side wall arms attached to each of the end walls the width of the arms on the end walls being within a distance, A, from the base ends with each side wall arm disposed to interlock with a side wall arm attached to an opposite end wall forming side walls upward-extending, the end walls and side walls forming an upright box with an open top and with the base as its bottom, and a pair of handle panels, one panel hinged and extending from each of the base sides alongside respective adjacent side walls a distance from the base sides substantially greater than the sum of distances A and B joining together at their distal ends to form a handle over the open, upright box, the upright box thus being supported by said handle panels from the box bottom.

* * * * *